United States Patent [19]

Mooney

[11] 4,003,474

[45] Jan. 18, 1977

[54] CRANE BOOM STOP ARRANGEMENT

[76] Inventor: Ralph Mooney, 3100 Eldogor Lane, New Castle, Pa. 16105

[22] Filed: May 5, 1975

[21] Appl. No.: 574,575

[52] U.S. Cl. ..... 212/59 A; 212/8 R

[51] Int. Cl.[2] ..... B66C 23/06

[58] Field of Search ..... 212/39, 59, 1, 8; 74/41

[56] References Cited

UNITED STATES PATENTS

| | | | |
|---|---|---|---|
| 2,999,601 | 9/1961 | Mork | 212/59 A |
| 3,123,223 | 3/1964 | Markwardt et al. | 212/59 A |
| 3,647,087 | 3/1972 | Mooney | 212/1 |

*Primary Examiner*—Robert J. Spar
*Assistant Examiner*—Lawrence J. Oresky
*Attorney, Agent, or Firm*—Colton & Stone, Inc.

[57] ABSTRACT

In a crane boom stop arrangement of the type having a compression strut which is pivotally mounted at one of its ends to the crane superstructure and a link strut pivotally connected to the opposite end of the compression strut and to the crane boom and in which the lengths of the struts and the locations of the pivotal connections are such that the outer end of the compression strut contacts the boom to limit the elevation thereof, the compression strut includes a telescoping section which extends only when the crane boom passes below its lower operating limit. The arrangement permits the boom to be lowered to the ground without the need of disconnection of any portion of the boom stop.

1 Claim, 8 Drawing Figures

FIG. 1
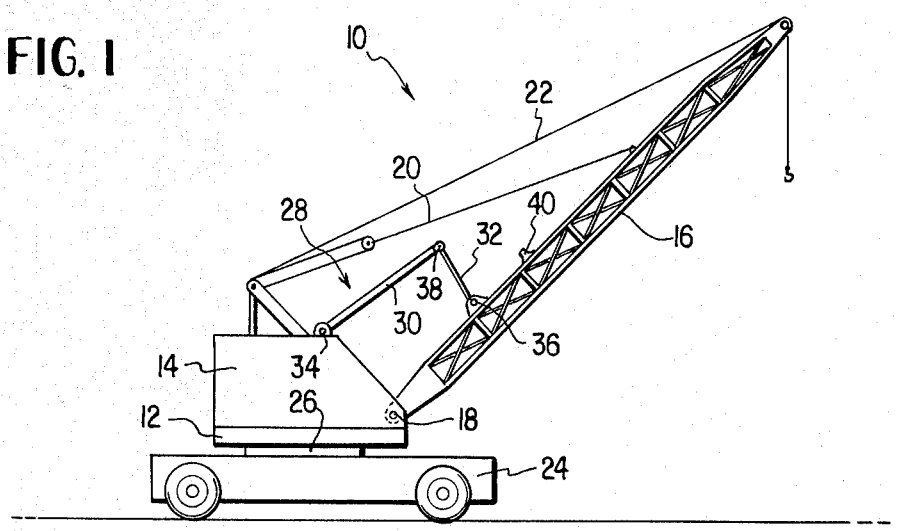
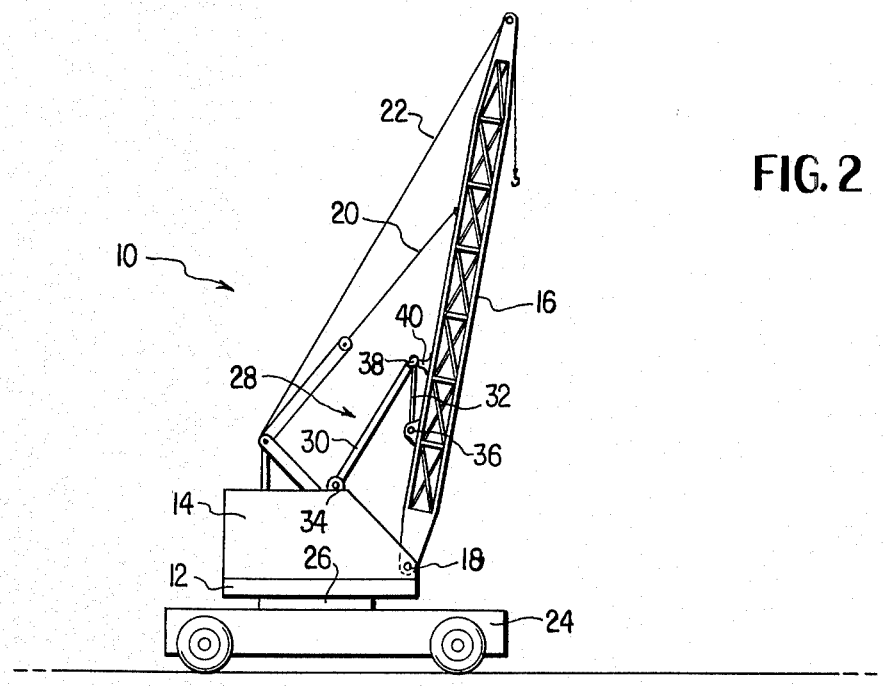
FIG. 2
FIG. 3
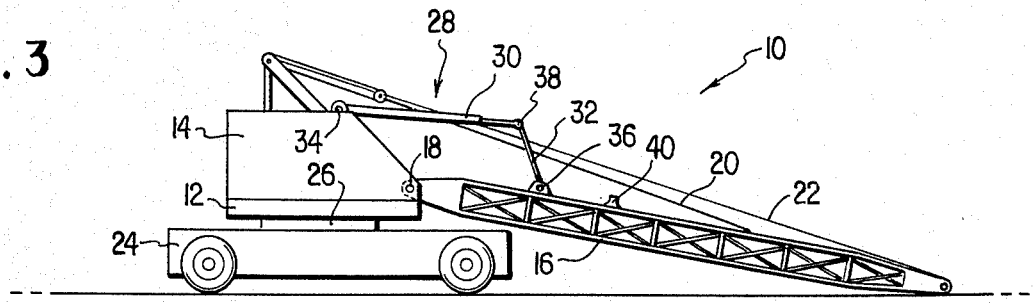

FIG. 7
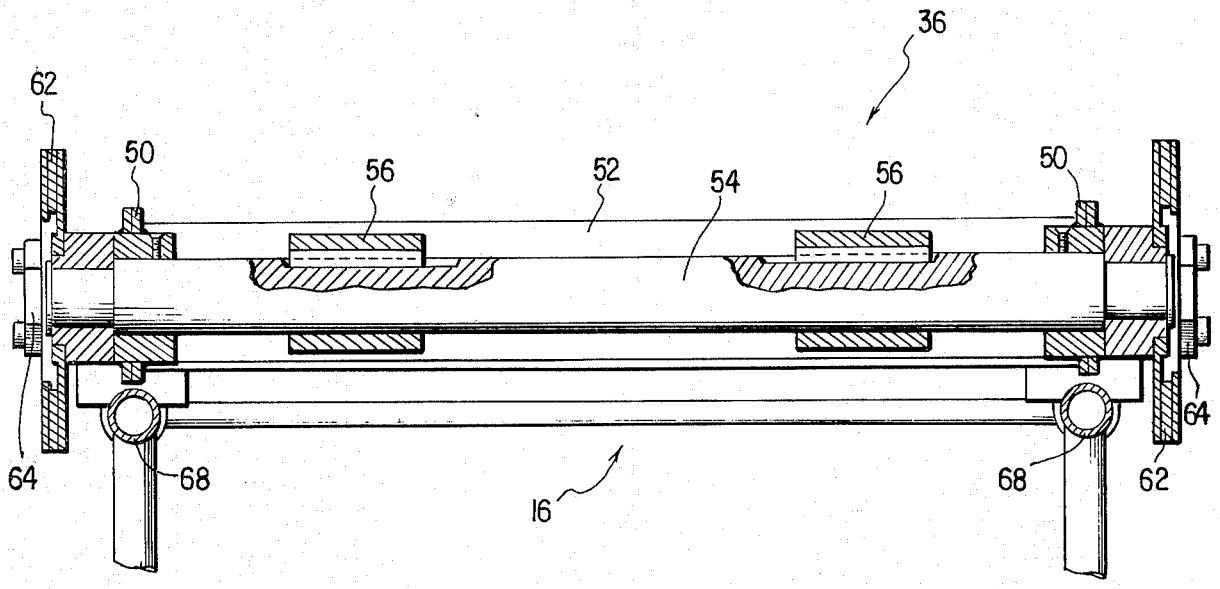
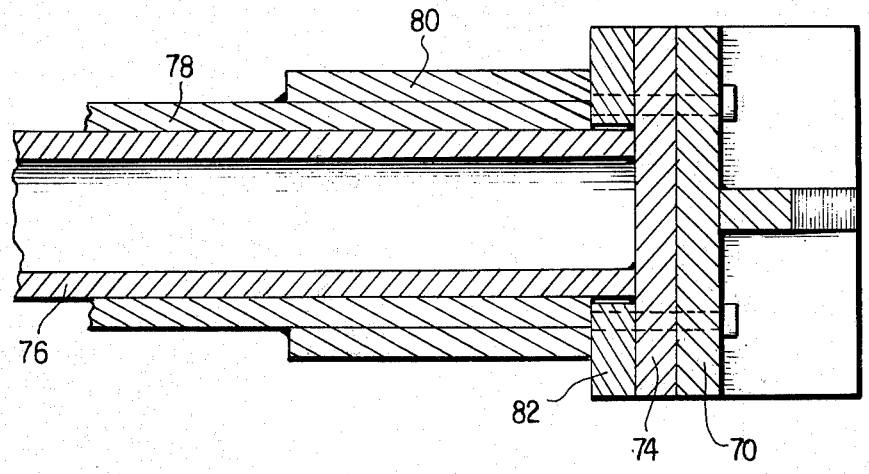
FIG. 8

CRANE BOOM STOP ARRANGEMENT

BACKGROUND OF THE INVENTION

The present invention pertains to crane boom stops and, more particularly, to an improved hinged boom stop arrangement.

Cranes and other load handling equipment with elongated booms pivotally mounted for movement in a vertical plane are frequently provided with some form of boom stop device to provide a positive upper limit of boom travel as well as to control boom recoil which may occur upon the breaking of a lifting cable or during movement of the crane over rough terrain, for example. One class of boom stop devices are the hinged boom stops. These boom stop devices consist, generally, of a compression strut which is pivotally connected at one end to the crane superstructure and a link strut pivotally connected at its opposite ends to the boom and to the compression strut, respectively, with the lengths of the compression and link struts and the locations of the pivotal connections being such that the compression strut contacts the boom when the boom is raised to its maximum working elevation. U.S. Pat. Nos. 2,999,601, Mork, and 3,647,087, Mooney, provide examples of boom stop devices of the hinged type.

On many cranes equipped with hinged boom stop devices, the lengths and mounting points of the compression and link struts are such that the boom stop device must be disconnected when the crane boom is to be lowered from the lower limit of its operating range to a ground engaging position. This is an undesirable arrangement as it is time consuming. Also, the presence of a readily removable connection between the boom stop device and the crane or boom structure makes it possible to inadvertently operate the crane without the boom stop device being in its operative condition, thus defeating the intended safety features of the boom stop device.

It is the primary object of the present invention to provide a hinged boom stop arrangement which permits full lowering of the crane boom without any disconnecting or disassembly of the boom stop or of the connections between the boom stop and the crane and boom structures.

It is also an object of the present invention to provide a boom stop arrangement permitting full lowering of the boom and which automatically assumes an operative position when the boom is elevated to any angle within the working range thereof.

A further object of the present invention is the provision of a boom stop device of the compression and link strut type permitting full lowering of the boom without the use of complex linkage arrangements.

Another object of the present invention is the provision, in a boom stop device having a compression strut and a link strut, of means permitting the full lowering of the crane boom without the need for the disconnection of any portion of the boom stop device, the means being readily adaptable to existing compression and link strut boom stop devices.

BRIEF SUMMARY OF THE INVENTION

As will become apparent in the following detailed description of the invention, the above objects are achieved by the provision of a boom stop device for a crane or the like of the type having an elongate boom pivotally mounted for movement in a vertical plane, which comprises a compression strut pivotally connected at one of its ends to the crane superstructure and a link strut connected by pivotal connections to the compression strut and the crane boom and in which the compression strut includes a telescoping section which is fully retracted when the crane boom is at or above the minimum angle of its operating range and which extends, lengthening the compression strut, as the boom moves below said minimum angle.

For a more complete understanding of the invention and the objects and advantages thereof, reference should be had to the following detailed description and the accompanying drawings wherein there is shown a preferred embodiment of the invention.

BRIEF DESCRIPTION OF THE DRAWINGS

FIG. 1 is a side elevational view of a mobile crane equipped with boom stop assembly of the present invention;

FIGS. 2 and 3 are views similar to that of FIG. 1 but showing the crane boom at its maximum working elevation and at its fully lowered position, respectively;

FIG. 7 is a transverse sectional view taken along the line 7–7 of FIG. 4; and

FIG. 8 is a fragmentary longitudinal sectional view taken along the line 8—8 of FIG. 4.

DETAILED DESCRIPTION OF THE PREFERRED EMBODIMENT

Figure 4:
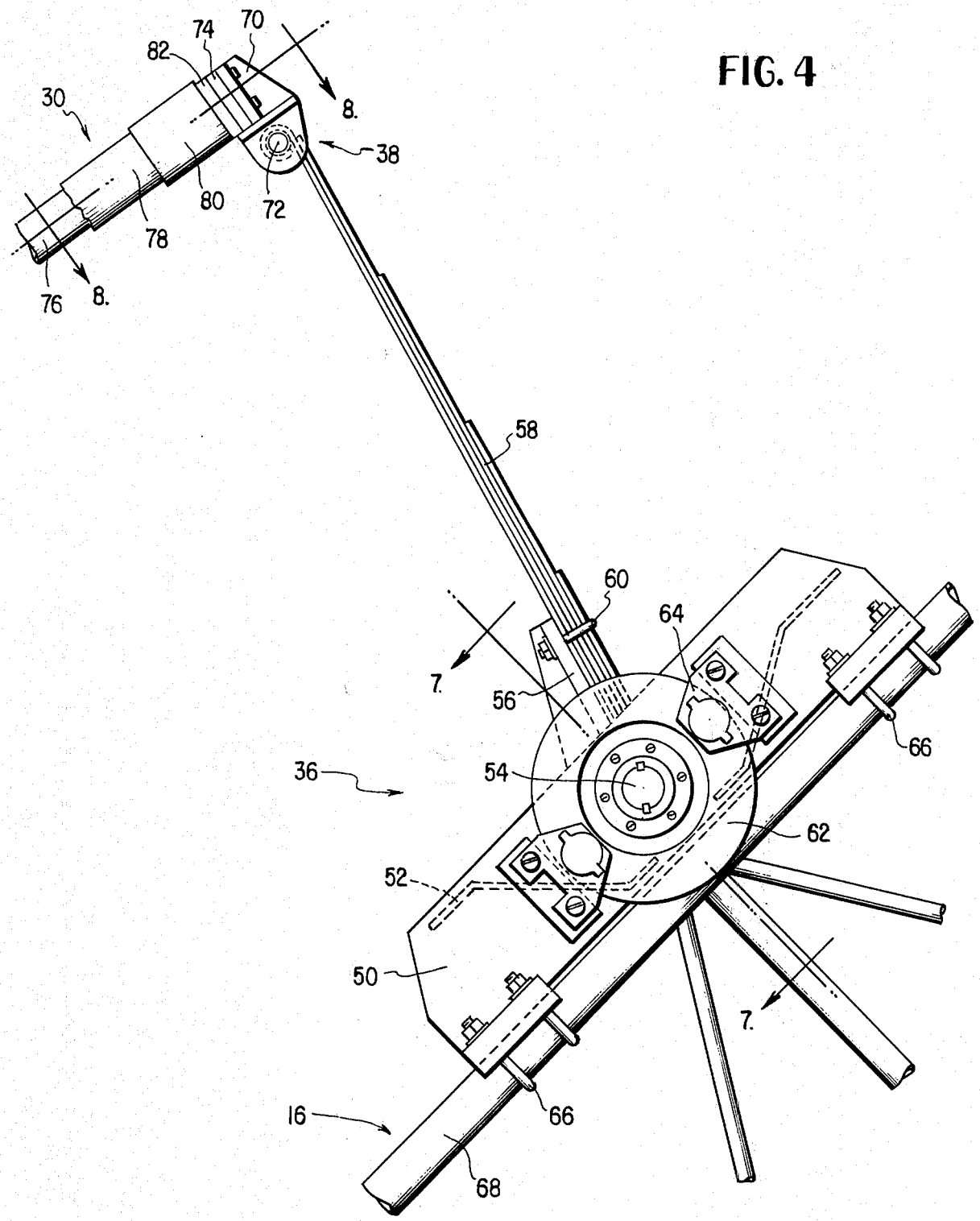
FIGS. 4–6 are fragmentary side elevational views, corresponding, respectively, to FIGS. 1–3 and on enlarged scales therefrom, showing the outer portions of the boom stop assembly and the associated portions of the crane boom.

In the following description of the preferred embodiment of the invention, the boom stop arrangement is illustrated in conjunction with a truck crane. It should be understood, however, that the invention is not so limited. Rather, the boom stop arrangement may be employed with any type of load handling device having a boom structure which pivots in a vertical plane.

The crane is designated generally by the reference numeral 10 and includes a main frame 12 on which the superstructure 14 is supported and to which the boom 16 is pivotally connected, the connection being indicated by the numeral 18. The boom 16 is raised and lowered by means of boom cables 20 which are connected to a winch and motor unit housed within the superstructure 14. A load lifting cable 22 is also provided, a second winch and motor unit being provided in the superstructure for control of this cable. The crane is mounted on a truck frame 24, the mounting means therefor comprising a turntable assembly 26 permitting the crane to rotate about a vertical axis.

A hinged boom stop assembly, designated generally by the reference numeral 28, provides a positive upper limit for the angle of elevation of the crane boom 16. The boom stop assembly comprises a compression strut 30 and a link strut 32, a pivotal connection 34 between the compression strut 28 and the crane frame 12, a second pivotal connection 36 connecting the link strut 32 to the boom 16, and a third pivotal connection between the compression strut 30 and the link strut 32. A stopblock 40 is provided on the boom 16 and is contacted by the end of the compression strut 30 when the boom is elevated to its upper limit. Preferably, the boom stop arrangement is equipped with controllable braking means at one of the pivotal connections, as taught in my U.S. Pat. No. 3,647,087, to provide control of boom movement throughout the operating range of the boom.

Figure 5:
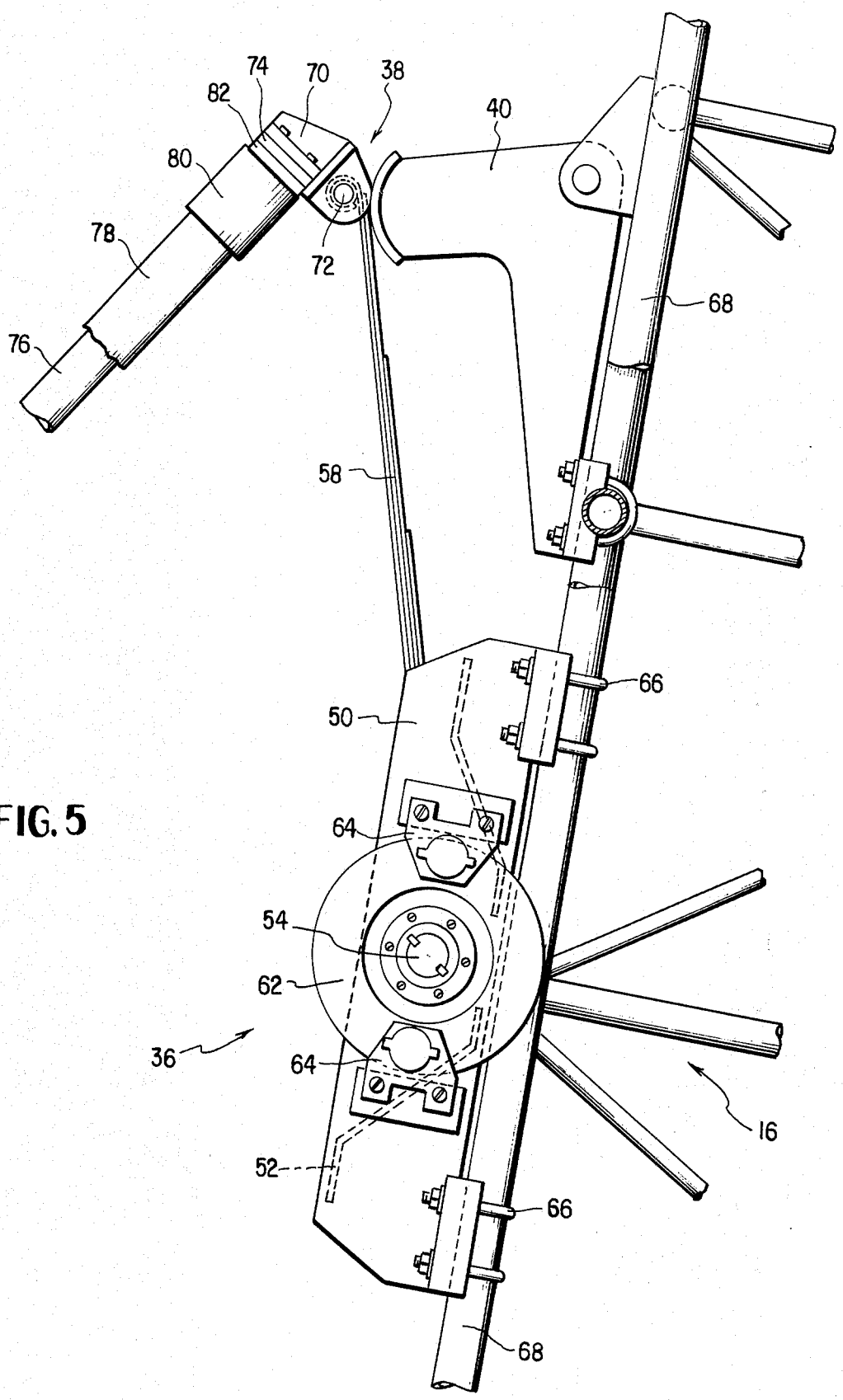
Figure 6:
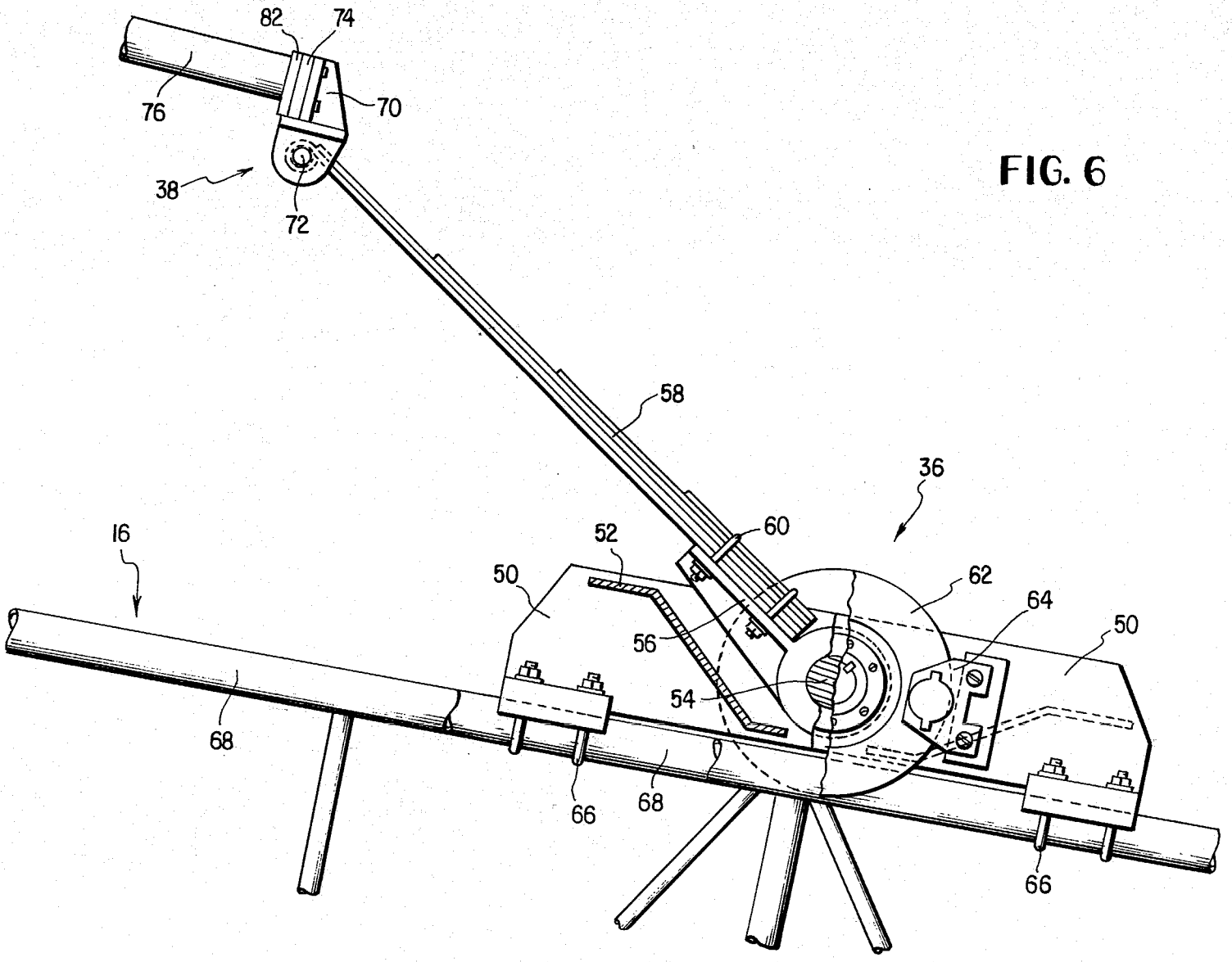

The boom stop mechanism is illustrated in greater detail in FIGS. 4–8 to which reference will now be made. A connecting structure is mounted on the crane boom and carries the link strut pivotal connection 36. The connecting structure is comprised of a pair of side plates 50 and transverse plate-like members 52. A shaft 54 is journalled in the side plates 50. Keyed to the shaft 54 are a pair of torque arms 56 each of which mounts a leaf spring 58, the springs 58 being secured by U-bolts 60. The torque arms 56 and lead springs 58 together constitute the link struts 36. Also keyed to the shaft 54 adjacent the side plates 50 are a pair of brake disks 62 and cooperating caliper brake units 64 are mounted on the side plates 50. U-bolts 66 secure the connecting structure to the upper channel or tube 68 of the boom section.

The compression strut 30 is connected to the end of the leaf spring 58 of the link strut 32 by means of a clevis 70 and pin 72. A plate 74 is welded or otherwise rigidly secured to the clevis 70 and serves to connect the compression strut 30 to the clevis 70. The compression strut 30 consists of an inner telescoping member 76 and an outer telescoping member 78. The inner member 76 is rigidly connected to the plate 74 while the outer member 78 is in sliding engagement with the inner member 76. The end of the outer member 78 is provided with a collar 80. Suitable means are provided at the opposite end of the outer member 78 to effect the pivotal connection 34 between the compression strut and the crane frame 12.

The length of the outer telescoping member 78 is such that the collar 80 abuts a plate 82 of the clevis 70 as long as the boom 16 is within its working range of elevation, that is, so long as the angle between the boom 16 and the horizontal is within the range of approximately 40° to approximately 80°. Thus, throughout the normal operating range of the crane boom, the boom stop assembly functions as a conventional hinged boom stop, the compression strut 30 being, effectively, a rigid member of fixed length. When the boom is being raised, the brake units 64 are released permitting the link strut 32 to rotate in a clockwise direction, when viewed as in FIGS. 1–3. At the upper limit of boom elevation, the end of the compression strut contacts the stopblock 40 to prevent further upward movement. Upon downward boom movement, the link strut 32 rotates in the opposite direction and, when the boom passes the lower limit of the operating range, the strut 32 will have rotated to its limit. The telescoping arrangement of the compression strut 30 then permits further lowering of the boom as the inner member 76 begins sliding out of the outer member 78 thus lengthening the compression strut 30 and permitting the boom to be lowered to permit disassembly, repair, and the like. It should be noted that the telescoping action of the compression strut is fully automatic and does not require the crane operator to effect any modification or disconnection of the boom stop assembly upon booming down. Also, as the boom is raised upwardly into its operating range, the compression strut 30 automatically telescopes back to its normal length and again provides control of boom movement.

I claim:

1. In a crane having a frame, an elongated boom pivotally connected to said frame for movement in a vertical plane, and a boom stop arrangement comprised of a compression strut pivotally connected at one of its ends to said frame at a point remote from the boom pivotal connection and a link strut pivotally connected to the other end of said compression strut and to said boom, the improvement wherein said compression strut comprises an extensible member having first and second sections in telescoping relation to one another, the arrangement being such that said compression strut is fully retracted throughout the operating range of boom movement and extends as said boom is moved below the lower limit of said operating range, the improvement being further characterized in that said first section of said compression strut is pivotally connected to said frame and a connector member is provided pivotally connecting said second section of said compression strut to said link strut, said first section having an end portion abutting said connector member when the angle of elevation of said boom is within said operating range.

* * * * *